US008253053B2

(12) United States Patent
Yang et al.

(10) Patent No.: US 8,253,053 B2
(45) Date of Patent: Aug. 28, 2012

(54) PUSH BUTTON SWITCH WITH LOCKING MECHANISM

(75) Inventors: Xin Yang, Shenzhen (CN); Wei Wu, Shenzhen (CN)

(73) Assignees: Fu Tai Hua Industry (Shenzhen) Co., Ltd., ShenZhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 305 days.

(21) Appl. No.: 12/824,468

(22) Filed: Jun. 28, 2010

(65) Prior Publication Data

US 2011/0185838 A1 Aug. 4, 2011

(51) Int. Cl.
*H01H 15/10* (2006.01)

(52) U.S. Cl. ..... 200/547; 200/4

(58) Field of Classification Search ..... 200/547, 200/4; 335/191

See application file for complete search history.

(56) References Cited

U.S. PATENT DOCUMENTS

| | | | | |
|---|---|---|---|---|
| 3,025,372 | A * | 3/1962 | Benjetsky | 335/207 |
| 4,871,885 | A * | 10/1989 | Kamada | 200/5 R |
| 6,069,545 | A * | 5/2000 | Van Zeeland | 335/207 |
| 6,967,301 | B2 * | 11/2005 | Krajci et al. | 200/547 |

* cited by examiner

*Primary Examiner* — Vanessa Girardi
(74) *Attorney, Agent, or Firm* — Altis Law Group, Inc.

(57) ABSTRACT

A push button switch includes a base, a locking member received in the base, a push button switch penetrating the base to engage with the locking member, and a lock body. The base defines a receiving chamber and includes first magnetic members. The push button switch defines a hole. The lock body includes second magnetic members, and penetrates the hole and the receiving chamber to engage with the base by the first magnetic members attracting the second magnetic member. The push button is limited to slide by the lock body and is slideable along the base when the lock body is driven to rotate relative to the push button by an external force.

13 Claims, 5 Drawing Sheets

PUSH BUTTON SWITCH WITH LOCKING MECHANISM

BACKGROUND

1. Technical Field

The present disclosure relates to switches and, particularly, to a locking push button switch.

2. Description of Related Art

In general, a switch can be used to turn on/off an electronic device by pushing a push button to actuate the switch. Although this switch satisfies basic requirements, a new switch is still called for.

DETAILED DESCRIPTION

Figure 1:
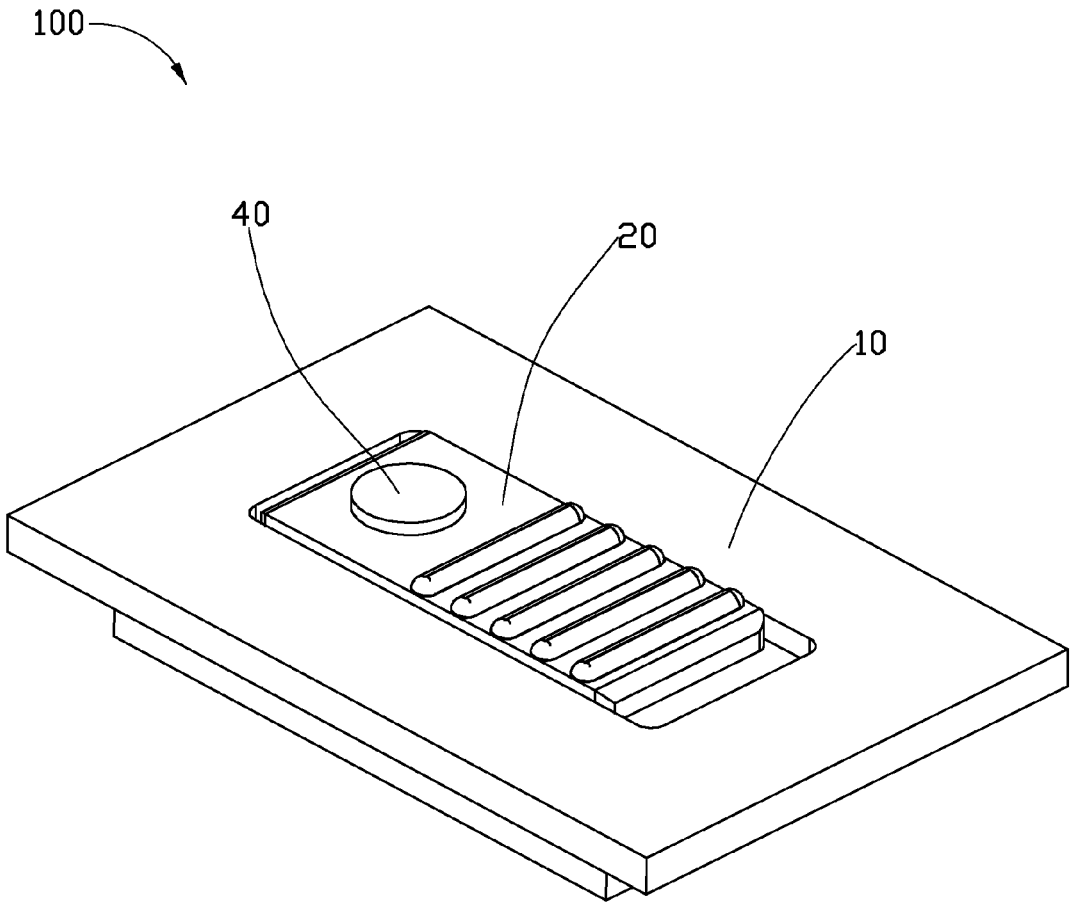
FIG. 1 is an isometric view of a push button switch in accordance with an exemplary embodiment.
Figure 2:
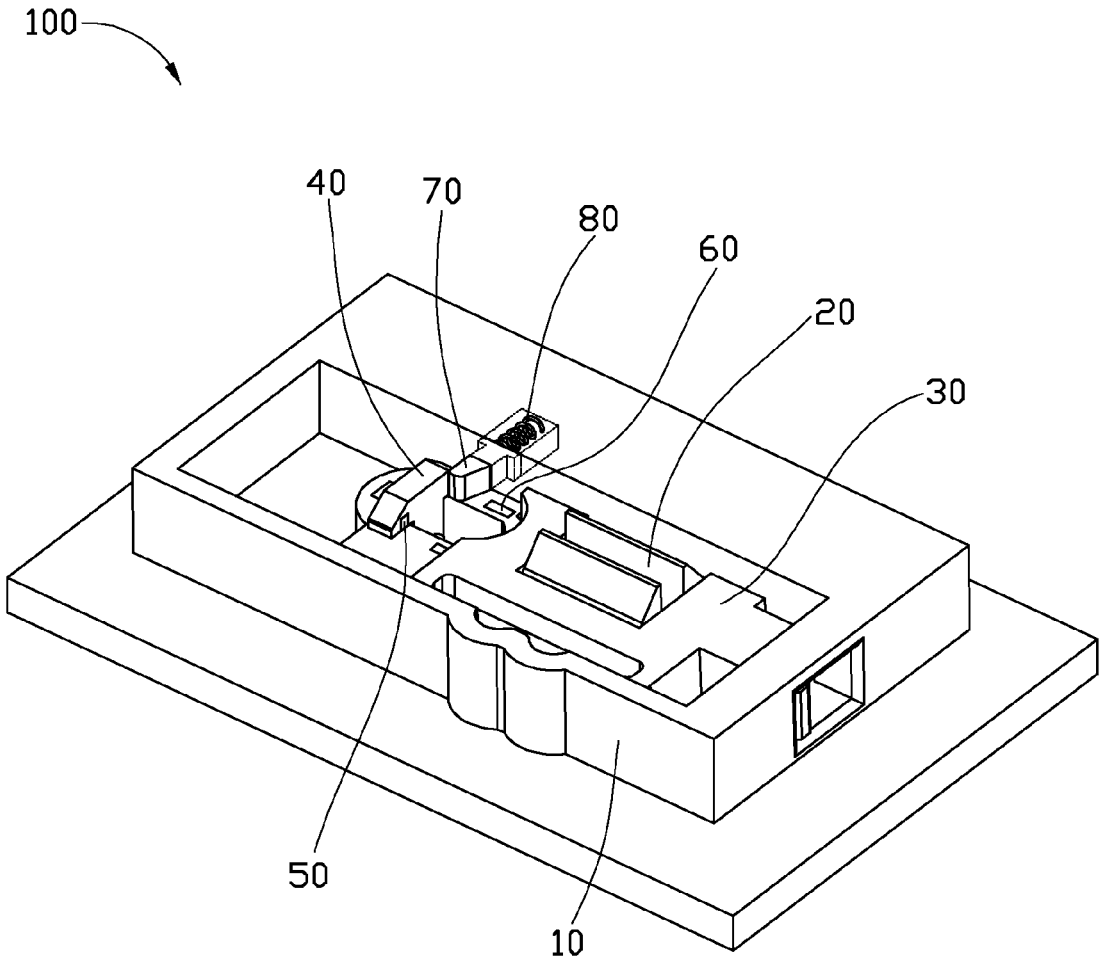
FIG. 2 is another isometric view of the push button switch of FIG. 1, viewed from another viewpoint.

Referring to FIGS. 1 and 2, a push button switch 100 is provided. The push button switch 100 includes a base 10, a push button 20, a locking member 30, a lock body 40 penetrating the base 10, two second magnetic members 50 mounted on the lock body 40, and six first magnetic members 60 mounted on the base 10.

Figure 3:
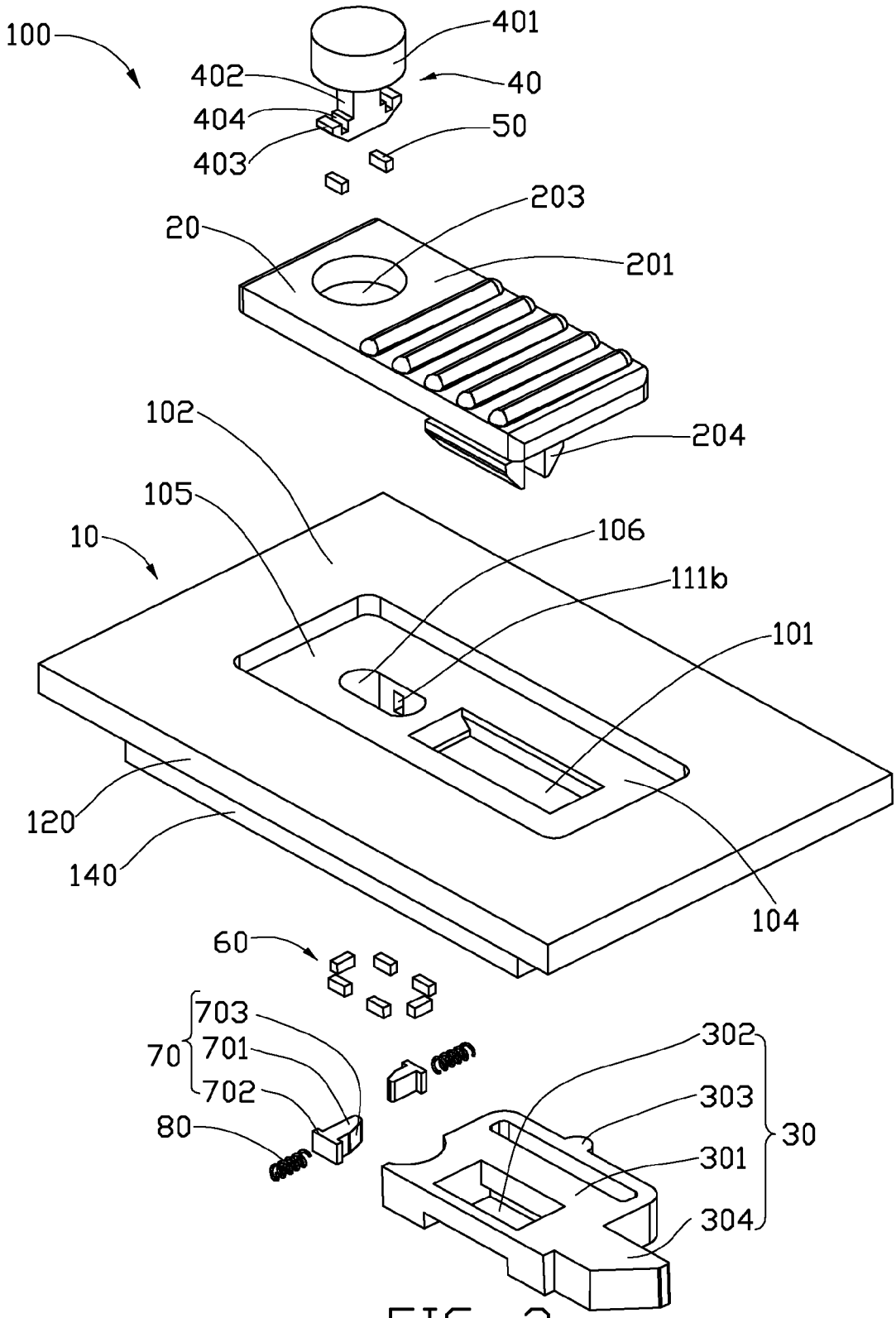
FIG. 3 is an exploded view of the push button switch of FIG. 1.

Referring to FIG. 3, the base 10 includes a lower plate 140 and a top plate 120 stacked on the lower plate 140. The base 10 defines an opening 101 and a receiving chamber 106 penetrating the top plate 120 and the lower plate 140.

The top plate 120 includes a top surface 102 defining a recessed portion 104 for receiving the push button 20. The recessed portion 104 has a length greater than a length of the push button 20, allowing the push button 20 to slide in the recessed portion 104.

Figure 4:
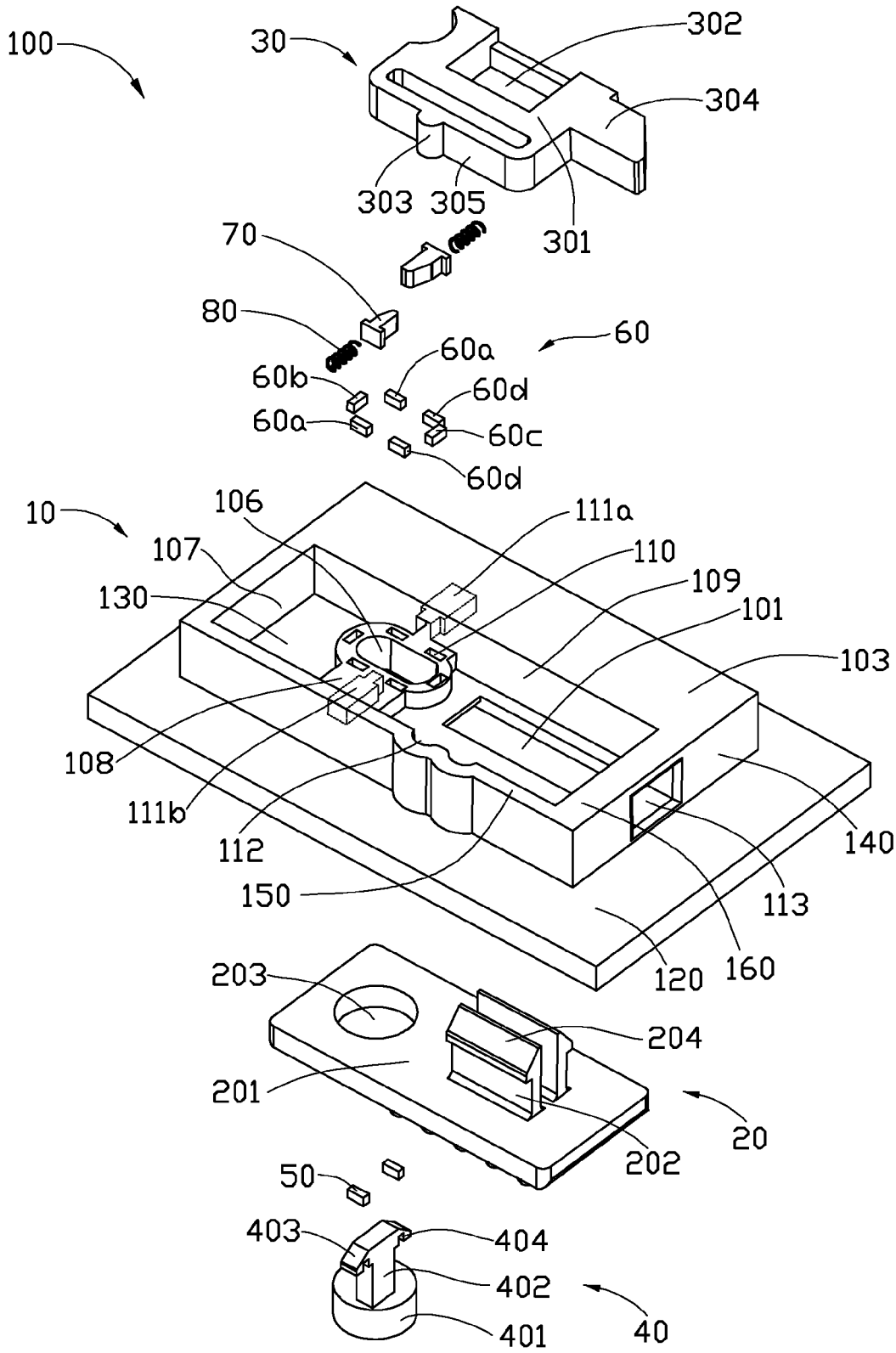
FIG. 4 is another exploded view of the push button switch of FIG. 1, viewed from another viewpoint.

Referring to FIG. 4, the lower plate 140 includes a bottom surface 103 defining a receiving space 107 for receiving the locking member 30. A wall 108 extends from the bottom of the recessed portion 107 and extends around the receiving chamber 106. The top surface of the wall 108 defines a plurality of openings 110 for receiving the first magnetic members 60. The openings 110 are evenly spaced from each other. In the embodiment, the wall 108 includes two opposite arcuate portions receiving two first magnetic members 60*b*, 60*c*, and opposite elongate portions receiving two pairs of the first magnetic members 60*a*, 60*d*.

The receiving space 107 includes a first sidewall 109 defining a first receiving space 111*a*. A second receiving space 111*b* opposite to the first receiving groove 111*a* is defined in the wall 108. The receiving space 107 also defines two adjacent positioning grooves 112 in a second sidewall 150 opposite to the first sidewall 109, and adjacent to the opening 101. The two positioning grooves 112 are configured for positioning the locking member 30. In the embodiment, the two positioning grooves 112 are cambered. The receiving space 107 further defines a guide hole 113 in a third sidewall 160 substantially perpendicularly connected to the first sidewall 109. The guide hole 113 is configured for guiding the locking member 30.

The locking member 30 is received in the receiving space 107 adjacent to the opening 101, and includes a main body 301, a hollow space 302 penetrating the main body 301, an elastic extrusion 303 and an extending block 304. The elastic extrusion 303 protrudes from a sidewall 305 of the main body 301, and is substantially cambered to match the positioning grooves 112 to position the locking member 30. The extending block 304 protrudes from another sidewall vertical to the sidewall 305, and is movably received in the guide hole 113.

The push button 20 includes a button body 201, two tabs 202 protruding from the button body 201 toward the top surface 102, and a hole 203 penetrating the button body 201. The two tabs 202 are substantially parallel to each other, and each includes a hook 204 at its end. The two tabs 202 penetrate the opening 101 and the hollow space 302 with the hooks 204 tightly engaging the main body 301 of the locking member 30, thereby connecting the push button 20 to the base 10 and the locking member 30. The locking member 30 can slide together with the push button 20 along the opening 101, allowing the extending block 304 to move in and out of the guide hole 113.

The lock body 40 is rotatably connected to the base 10, and includes a knob 401, a holding portion 402 extending from the knob 401 toward the top surface 102, two opposite extending ends 403 extending outward from an end of the holding portion 402, and two opposite concave portions 404 formed in the extending ends 403. The holding portions 402 penetrate the hole 203 and the receiving chamber 106 with the two opposite extending ends 403 engaging the wall 108, thereby rotatably connecting the lock body 40 to the base 10. The knob 401 is substantially cylindrical and has a thickness greater than the depth of the hole 203, allowing a user to rotate the knob 401. The two concave portions 404 are configured for receiving the second magnetic members 50.

The push button switch 100 further includes two stopping members 70 and two elastic members received in the receiving spaces 111*b*, 111*a*, respectively. The two stopping members 70 are set in relative positions. Each stopping member 70 includes a head 702 and a stem 701 extending from the head 702. Each stem 701 includes a substantially wedge-shaped end 703. The two heads 702 are slidably received in the receiving grooves 111*a*, 111*b*, respectively. The two stems 701 extend out of the receiving grooves 111*a*, 111*b* for preventing the opposite extending ends 403 of the lock body 40 from rotating.

The two elastic members 80 are connected to the two stopping members 70, respectively. Ends of the two elastic members 80 are connected to a sidewall of the receiving grooves 111*a* and 111*b*, and the opposite ends are connected to the heads 702 of the stopping members 70, respectively. In the embodiment, when the push button 20 is pushed to move, the lock body 40 moves and pushes against the wedge-shaped ends 703 of the stem 701. Because of the wedge-shaped ends 703, the stems 701 are driven to move into the receiving space 111*a* and 111*b*, which compress the elastic members 80. When the elastic members 80 rebound, the stems 701 are driven to move out of the receiving space 111*a* and 111*b*.

Figure 5A:
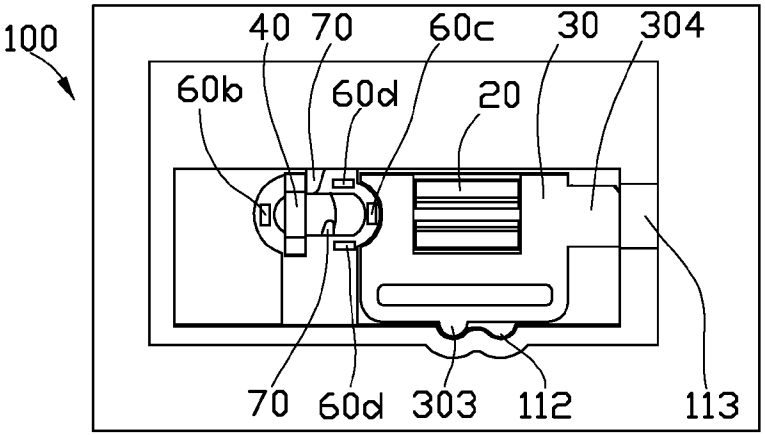
FIGS. 5A-5D are schematic views of the push button switch of FIG. 1, showing a process of moving a push button of the push button switch from a first position to a second position.
Figure 5B:
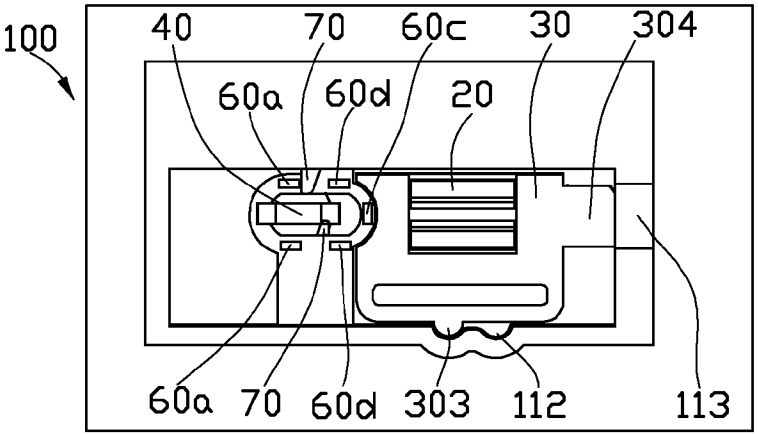

Referring to FIGS. 5A-5B, a process for changing the push button switch 100 from a first state to a second state will be described in detail. Herein, the first state is when the push button 20 is locked in a first position (as shown FIG. 5A). In the first state, the extending block 304 of the locking member 30 is received in the guide hole 113. The two stems 701 extend out of the receiving grooves 111*a*, 111*b* and the two wedge-shaped ends 703 prevents the opposite extending ends 403 of the lock body 40 from rotating. The first magnetic members 60*a* attract the second magnetic members 50 of the extending ends 403, thereby locking the push button 50. The second state is when the extending block 304 is extended out of the guide hole 113, and the push button 20 is locked in a second position by the two wedge-shaped ends 703 and the two first magnetic members 60*d* attracting the second magnetic member 50 (as shown FIG. 5D).

Figure 5C:
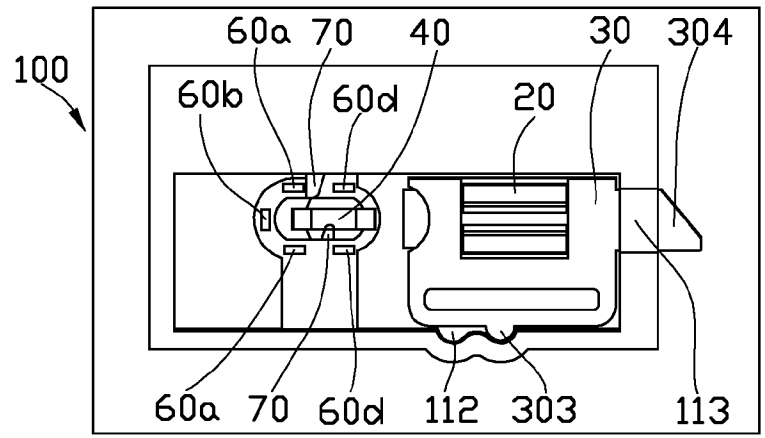

To change the push button switch 100 from the first state to the second state, the knob 401 of the lock body 40 is first rotated to cause one of the two extending ends 403 to rotate from the first magnetic member 60*a* (as shown in FIG. 5A) to the first magnetic member 60*b* (as shown FIG. 5B), thereby driving one of the stems 701 to move into the receiving space 111*b* to compress the elastic member 80. That is, the push button 20 is unlocked. The push button 20 is then pushed toward the guide hole 113 until the extending block 304 moves out of the guide hole 113 (as shown FIG. 5C). During the process, one of the two extending ends 403 is moved and attracted by the first magnetic member 60*c*, and the elastic extrusion 303 is moved into another positioning groove 112 adjacent to the guide hole 112, thereby positioning the locking member 30 (as shown FIG. 5C).

Figure 5D:
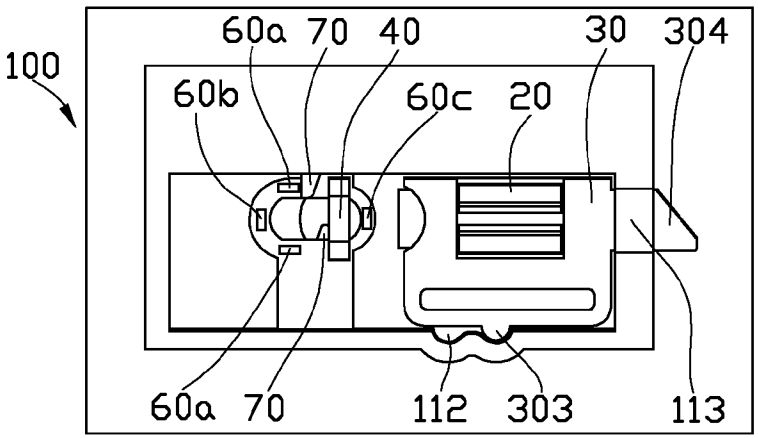

After the extending blocks 304 extends out of the guide hole 113, the knob 401 of the lock body 40 is rotated again to cause the two extending ends 403 move from the first magnetic member 60*c* to the magnetic member 60*d* (as shown FIG. 5D). After the two extending ends 403 have been moved to the first magnetic member 60*d*, the second magnetic members 50 of the two extending ends 403 attract the first magnetic members 60*d*, and one of the elastic members 80 rebounds to drive one of the two stopping members 70 to extend out of the receiving grooves 111*a*, 111*b* to prevent the lock body 40 from sliding along the wall 108. Thus, the push button 20 is locked in the second position.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. A push button switch comprising:

a base defining a receiving chamber and comprising a plurality of first magnetic members;

a locking member received in the base;

a push button penetrating the base to engage with the locking member, and defining a hole; and a lock body comprising a plurality second magnetic members, and penetrating the hole and the receiving chamber to engage with the base by the first magnetic members attracting the second magnetic members;

wherein the push button is limited to slide by the lock body and is slideable along the base when the lock body is driven to rotate relative to the push button by an external force.

2. The push button switch as described in claim 1, wherein the base comprises a top plate comprising a top surface defining a recessed portion, and the recessed portion is configured for receiving the push button.

3. The push button switch as described in claim 2, wherein the recessed portion has a length greater than a length of the push button, allowing the push button to slide in the recessed portion.

4. The push button switch as described in claim 2, wherein the base further comprises a lower plate comprising a bottom surface defining a receiving space for receiving the locking member.

5. The push button switch as described in claim 4, wherein the base defines an opening penetrating the top plate and the lower plate, the locking member comprises a main body and a hollow space penetrating the main body, the push button comprises two tabs comprising two hooks at the two tabs' end, the two holding portions penetrate the opening and the hollow space with the hooks tightly engaging the main body of the locking member, thereby connecting the push button to the base and the locking member.

6. The push button switch as described in claim 5, wherein a wall extends from a bottom of the recessed portion and extends around the receiving chamber, the wall comprises a top surface defining a plurality of openings for receiving the first magnetic members.

7. The push button switch as described in claim 6, wherein the lock body comprises a knob, a holding portion extending from the knob, two opposite extending ends extending outward from an end of the holding portion, and two opposite concave portions formed in the extending ends, the holding portions penetrate the hole and the receiving chamber with the two opposite extending ends engaging the wall, thereby rotatably connecting the lock body to the base, and the two concave portions are configured for receiving the second magnetic members.

8. The push button switch as described in claim 7, further comprising two stopping members slideable connected the base, and set in relative positions, the receiving space comprises a first sidewall defining a first receiving space, a second receiving space opposite to the first receiving space is defined in the wall, the first receiving space and the second receiving space are configured for receiving the two stopping members.

9. The push button switch as described in claim 8, wherein the two stopping members each comprises a head and a stem extending from the head, the two stems each comprises a substantially wedge-shaped end, the two heads are slidably received in the first receiving space and the second receiving space, the two stems are extended out of the first receiving space and the second receiving space, for preventing the opposite extending ends of the lock body from rotating along the wall.

10. The push button switch as described in claim 9, further comprising two elastic members connected to the two stopping members respectively, ends of the two elastic members are connected to a sidewall of the first receiving space and the second receiving space, and the opposite ends are connected to the heads of the stopping members, respectively.

11. The push button switch as described in claim 8, wherein the receiving space further defines two adjacent positioning grooves adjacent to the opening in a second sidewall opposite to the first sidewall, the two positioning grooves are substantially cambered, the locking member further comprises an elastic extrusion protruding from a sidewall of the main body, and is substantially cambered to match the positioning grooves to position the locking member.

12. The push button switch as described in claim 11, wherein the receiving space further defines a guide hole in a third sidewall substantially perpendicularly connected to the first sidewall, the locking member further comprises an extending block movably received in the guide hole.

13. The push button switch as described in claim 1, wherein the number of the first magnetic members is six, and the number of the second magnetic members is two.

* * * * *